US006093918A

United States Patent [19]

Sohn

[11] Patent Number: 6,093,918

[45] Date of Patent: Jul. 25, 2000

[54] COOLING DEVICE FOR MICROWAVE OVENS WITH HALOGEN LAMP

[75] Inventor: Hwi-Chang Sohn, Changwon Gyeongnam, Rep. of Korea

[73] Assignee: LG Electronics Inc., Seoul, Rep. of Korea

[21] Appl. No.: 09/362,893

[22] Filed: Jul. 29, 1999

[30] Foreign Application Priority Data

Jul. 29, 1998 [KR] Rep. of Korea ..... 98-14104

[51] Int. Cl.[7] ..... H05B 6/80

[52] U.S. Cl. ..... 219/685; 219/757; 126/21 A

[58] Field of Search ..... 219/685, 680, 219/681, 757; 126/21 A

[56] References Cited

U.S. PATENT DOCUMENTS 4,096,369 6/1978 Tanaka et al. ..... 219/685
4,296,297 10/1981 Miller ..... 219/757
4,618,756 10/1986 Schwaderer et al. ..... 219/757

FOREIGN PATENT DOCUMENTS 61-285320 12/1986 Japan ..... 219/757
5-52352 3/1993 Japan ..... 219/757

*Primary Examiner*—Philip H. Leung
*Attorney, Agent, or Firm*—Fleshner & Kim, LLP

[57] ABSTRACT

A cooling device for microwave ovens with halogen lamps is disclosed. The cooling device is designed to divide the cooling air current, generated from a cooling fan unit, into two currents, an upper current and a lower current. The upper and lower currents are respectively fed to the passages above and below the top wall of a cavity. The cooling device comprises a halogen lamp installed on the top wall of the cavity and radiates heating light into the cavity. A lamp protection filter is provided on the top wall of the cavity and allows the heating light to be led from the halogen lamp into the cavity. A cooling fan unit generates the cooling air current, which is guided to the passages above and below the top wall of the cavity.

12 Claims, 3 Drawing Sheets

COOLING DEVICE FOR MICROWAVE OVENS WITH HALOGEN LAMP

BACKGROUND OF THE INVENTION

1. Field of the Invention

The present invention relates, in general, to a cooling device for microwave ovens with a halogen lamp and, more particularly, to a cooling device designed to allow a cooling air current passing along both a light reflection plate and a lamp protection filter.

2. Description of the Prior Art

As well known to those skilled in the art, a variety of cooking devices have been proposed and used. Of the cooking devices, the primary one is cooking ware, which is designed to have a shape suitable for containing food therein and is laid on a heater so as to be directly heated by the heater while cooking.

In addition, several types of electric cooking devices, designed to directly or indirectly utilize electric power while cooking, have been proposed and used. An example of conventional electric cooking devices is a microwave oven using a magnetron as a heat source. In such a microwave oven, the magnetron is electrically operated to generate microwaves and applies the microwaves to food in a cavity, thus allowing the microwaves to cause an active molecular motion in the food. Such an active molecular motion in the food generates molecular kinetic energy, thus heating and cooking the food. Such microwave ovens are advantageous in that they have a simple construction and are convenient to a user while cooking, and easily and simply heat food in the cavity. The microwave ovens are thus somewhat preferably used for some cooking applications, such as a thawing operation for frozen food or a heating operation for milk requiring to be heated to a desired temperature.

However, such microwave ovens also have the following problems. That is, the ovens have a defect in their heating style in addition to limited output power of the magnetron, and so it is almost impossible to freely or preferably use them for a variety of cooking applications, without limitation. In a detailed description, the conventional microwave ovens only utilize a magnetron as a heat source, thus undesirably having a single heating style. In addition, the output power of the magnetron, installed in such ovens, is limited to a predetermined level. Therefore, the conventional microwave ovens fail to provide a quick and highly effective cooking operation. During a cooking operation utilizing such a microwave oven, food in a cavity is heated at its internal and external portions at the same time, and this may be an advantage of the oven in some cases. However, such a heating style may result in a disadvantage while cooking some food. For example, the cooking style of the conventional microwave ovens is not suitable for cooking pizza for reasons that will be described in more detail later herein. Another disadvantage, experienced in the conventional microwave ovens, resides in that the ovens exceedingly remove moisture from food.

In an effort to overcome the above-mentioned problems, several types of microwave ovens, having another heat source in addition to a magnetron, have been proposed and used. For example, a microwave oven, having a convection heater in addition to a magnetron in a casing and originally designed to be used for a variety of cooking applications, has been proposed. However, such a convection heater only acts as a single heat source, thus failing to allow the microwave oven to have a variety of operational functions.

In a brief description, the conventional microwave ovens are problematic in that they have a single heating style utilizing microwaves, limited output power of a magnetron, and cause the evaporation of an exceeding amount of moisture from food. The microwave ovens, having another heater in addition to a magnetron, fail to completely overcome the problems experienced in the conventional microwave ovens.

In order to solve the problems of the conventional microwave ovens, another type of microwave oven, utilizing a light wave, has been proposed. In this microwave oven, a lamp, wherein at least 90% of the radiation energy has a wavelength of not longer than 1 $\mu$m, is used as the additional heat source. In said microwave oven, both visible rays and infrared rays from the lamp are appropriately used, and it is possible to preferably heat the exterior and interior of food while making the most of characteristics of the food. An example of such a lamp is a halogen lamp.

Due to a difference in wavelengths between the infrared rays and visible rays emanating from a halogen lamp, the heating styles for the exterior and interior of food are different from each other. While cooking pizza utilizing a halogen lamp, it is possible to appropriately heat the pizza in a way such that the exterior of the pizza is heated to become crisp and the interior is heated to be soft while maintaining appropriate moisture.

FIG. 1 is a conventional microwave oven utilizing a halogen lamp as an additional heat source. As shown in the drawing, the microwave oven comprises a halogen lamp 12 installed on the top wall 10 of a cavity 2. The microwave oven uses the light waves, radiated from the lamp 12, for heating food in the same manner as that described above, with the characteristics of the light waves remaining the same as that described above.

A light reflection plate 14 is installed at a position above the halogen lamp 12, thus reflecting any light waves, emanating upwardly from the lamp 12, back downwardly into the cavity 2. A plurality of light transmitting holes 16 are formed on the top wall of the cavity 2, with the halogen lamp 12 being held on the top wall.

The microwave oven also has a device for cooling the halogen lamp 12. The detailed construction of a typical cooling device for the halogen lamp 12 is shown in FIG. 2. As shown in the drawing, the typical cooling device comprises a cooling fan unit 20 installed on the top wall 10 of the cavity 2 at a position around the light reflection plate 14. The cooling fan unit 20 is designed to allow a cooling air current, radiated from the unit 20, to pass over the top wall 10 of the cavity 2. The air current thus cools the parts installed on the top wall 10 of the cavity 2.

A mesh member 15, having the light transmitting holes 16, is installed under the halogen lamp 12, which is positioned under the reflection plate 14. The above mesh member 15 allows the light, radiated from the lamp 12, to pass into the cavity 2 through the holes 16. The member 15 also prevents the microwaves from being undesirably led from the cavity 2 to the lamp 12 and from damaging the surface of the lamp 12.

A lamp protection filter 18, made of a light transmitting material, such as glass, is provided on the top wall 10 of the cavity 12. The objective of the protection filter 18 is to protect the halogen lamp 12 from impurities, such as steam and/or oil smoke, rising from food during a cooking operation.

The above cooling device is problematic as follows.

During a cooking operation, the lamp protection filter 18 is heated to a high temperature, for example, about 800° C. to 900° C. However, the cooling device is free from any means for cooling the protection filter 18. Also the impurities, or the steam and oil smoke emanating from food while cooking, are adhered to the filter 18. However, the cooling device lacks of means for protecting the filter 18 from such impurities. When the impurities are adhered to the filter 18, the light transmissivity of the filter 18 is reduced, thus undesirably lengthening the heating time for food and reducing the expected life span of the halogen lamp 12.

SUMMARY OF THE INVENTION

Accordingly, the present invention has been made keeping in mind the above problems occurring in the prior art, and an object of the present invention is to provide a cooling device, which is designed to allow a cooling air current passing along both a reflection plate and a lamp protection filter, thus effectively cooling the protection filter and effectively protecting the filter from impurities rising from food during a cooking operation.

In order to accomplish the above object, the present invention provides a cooling device for microwave ovens, comprising: light radiating means installed on a top wall of a cavity of a microwave oven and used for radiating heating light into the cavity; light transmitting means provided on the top wall of the cavity and used for allowing the heating light to be led from the light radiating means into the cavity; and cooling means for generating a cooling air current and guiding the cooling air current to passages above and below the top wall of the cavity.

In the above cooling device, the light transmitting means includes protection means, the protection means being made of a light transmitting material and being used for protecting the light radiating means.

In an embodiment, the cooling means comprises a cooling fan unit placed at a position where the cooling air current is divided by the top wall of the cavity into two currents respectively guided to the passages above and below the top wall of the cavity.

In another embodiment, the cooling means comprises: cooling air current generating means; and air current guiding means for dividing the cooling air current from the air current generating means into two currents and guiding the two currents to the passages above and below the top wall of the cavity.

In the cooling device of this invention, the cooling air current is divided into upper and lower currents. The upper current cools both the halogen lamp and the light reflection plate, which are installed on the upper surface of the top wall of the cavity. The lower current cools the lamp protection filter provided under the halogen lamp. The lower current also protects the lamp protection filter from steam and oil smoke rising from food during a cooking operation. Therefore, the lower current prevents impurities, laden in the steam and oil smoke, from being adhered to the lamp protection filter.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
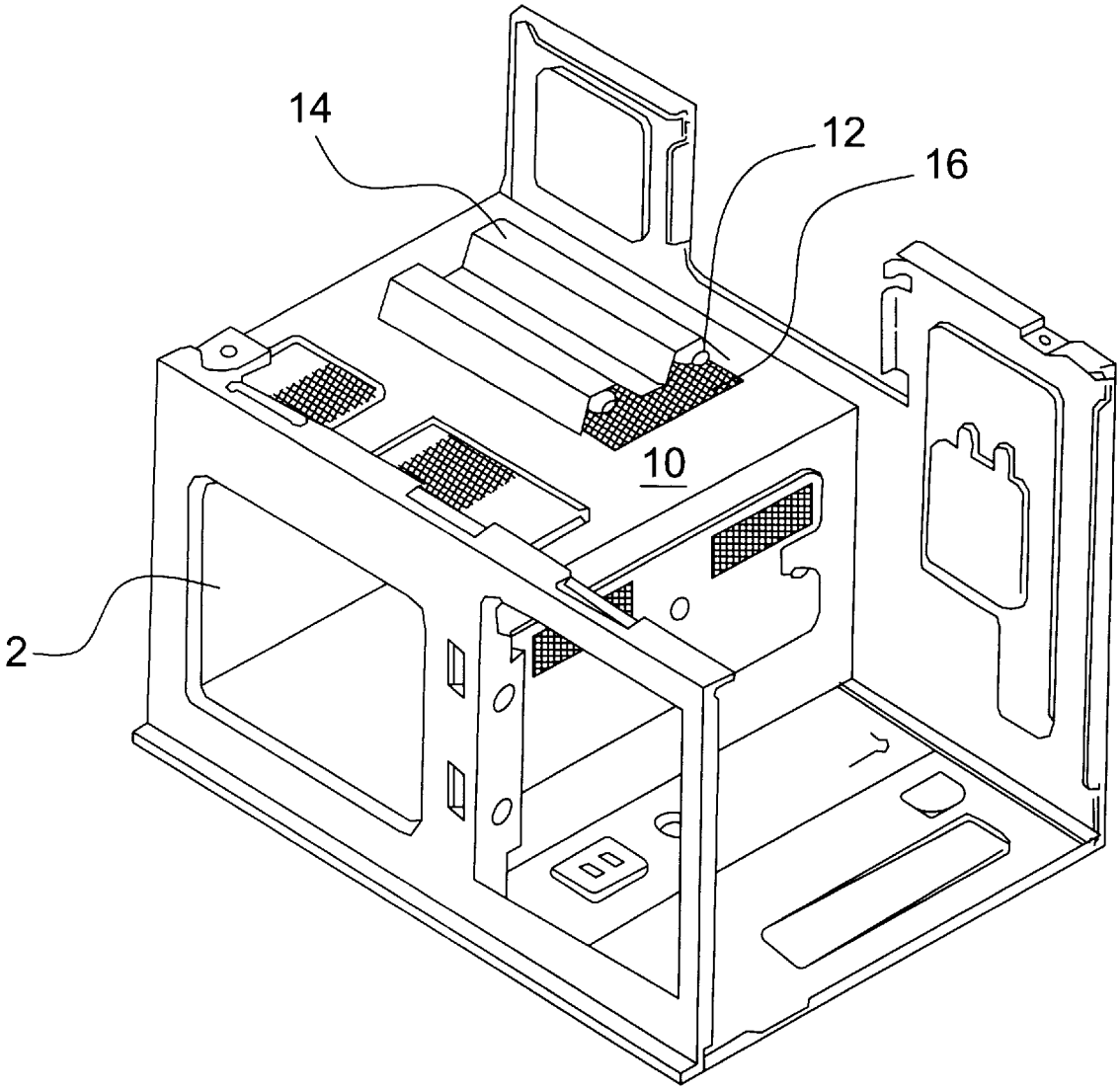
FIG. 1 BACKGROUND ART
FIG. 1 is a perspective view, showing the construction of a conventional microwave oven utilizing a halogen lamp as an additional heat source.
Figure 2:
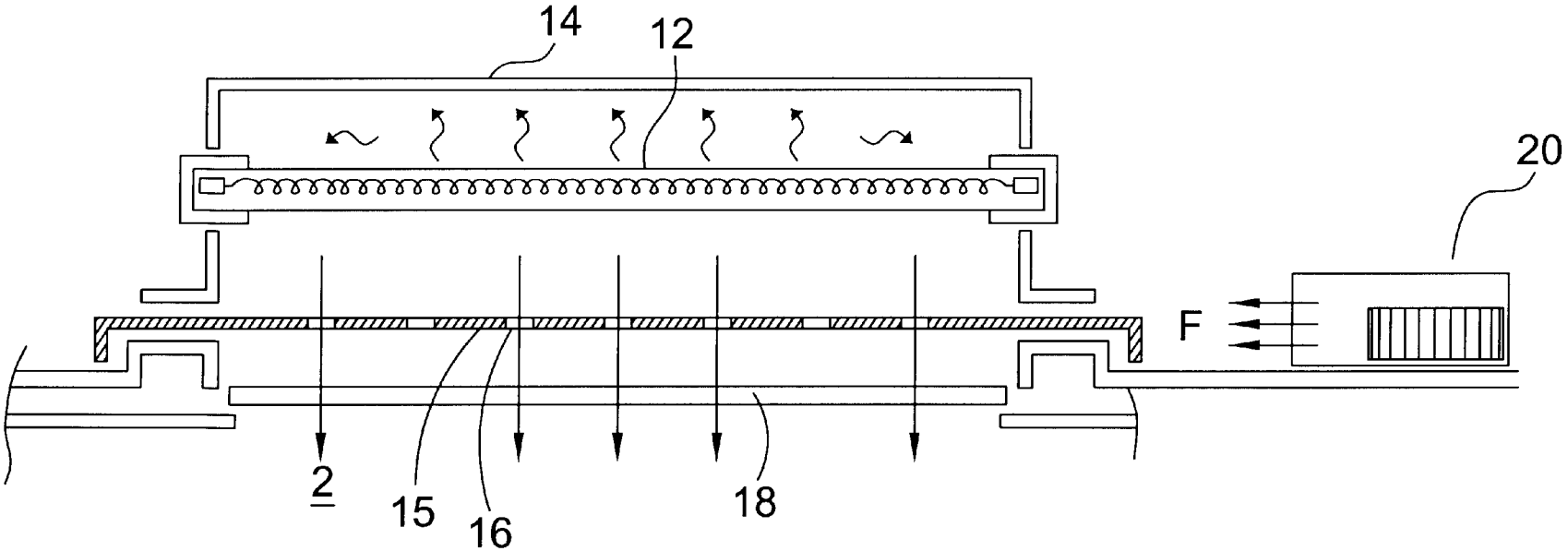
FIG. 2 BACKGROUND ART
FIG. 2 is a sectional view, showing a typical cooling device provided in the microwave oven for cooling the halogen lamp.
Figure 3:
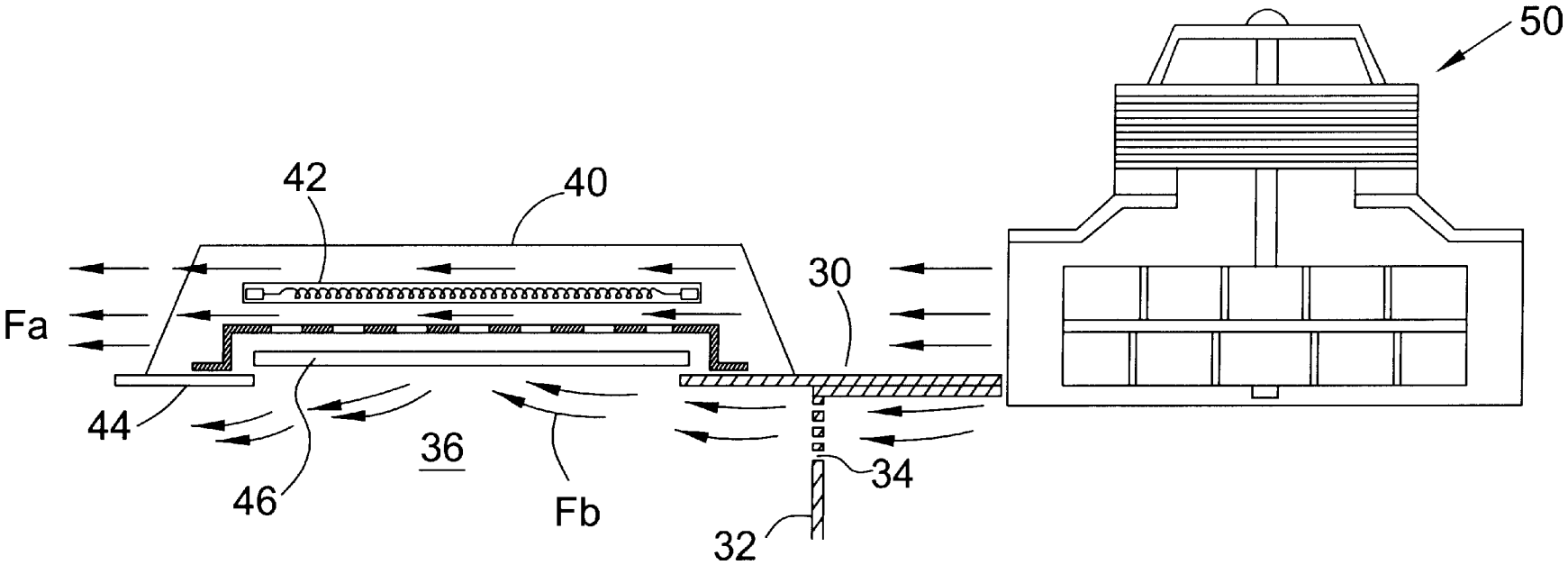
FIG. 3 is a sectional view, showing a cooling device provided in a microwave oven for cooling a halogen lamp in accordance with the preferred embodiment of the present invention.

FIG. 3 is a sectional view, showing a cooling device provided in a microwave oven for cooling a halogen lamp in accordance with the preferred embodiment of the present invention. The halogen lamp 42 is positioned above a top wall 30 of a cavity of the microwave oven. A plurality of light transmitting holes in a screen 44 allow light from the halogen lamp 42 to pass into the cavity 36 of the microwave oven. As shown in the drawing, the cooling fan unit 50 of the device generates a cooling air current. In the present invention, the cooling air current is divided into two currents, an upper current Fa and a lower current Fb. The upper and lower currents Fa and Fb are respectively fed to the passages above and below the top wall 30 of a cavity.

That is, the cooling air current, generated from the cooling fan unit 50, is divided into upper and lower currents Fa and Fb, which are respectively fed to the passages above and below the top wall 30 of the cavity. In order to divide the cooling air current from the unit 50 into two currents Fa and Fb, the cooling device of this invention may be designed as follows. That is, the air outlet port of the unit 50 may be placed at a position, at which the cooling air current of the unit 50 is divided into two currents by the top wall 30 of the cavity 36. Alternatively, the cooling air current from the unit 50 may be divided into two currents and guided to the passages above and below the top wall 30 of the cavity 36 by a separate duct.

The upper current Fa passes over the upper surface of the top wall 30, thus cooling both the reflection plate 40 and the halogen lamp 42 in the same manner as that described for the typical cooling device. On the other hand, the lower current Fb is guided into the cavity 36 through the air holes 34 formed on the sidewall 32 of the cavity 36. In such a case, the lower current Fb flows upwardly on the lower surface of the top wall 30 within the cavity 36. That is, the lower current Fb flows over the lower surface of the lamp protection filter 46 installed on the top wall 30 of the cavity 36. The flowing passage of the upper and lower air currents Fa and Fb is shown by the arrows in FIG. 3.

The lower current Fb, flowing over the lower surface of the lamp protection filter 46 within the cavity 36, has the following operational function. First, the lower current Fb cools the protection filter 46. The protection filter 46 is heated to a high temperature during a cooking operation. Therefore, when the filter 46 and the peripheral equipment around the filter 46 are cooled by the lower current Fb, they are effectively protected from thermal damage. Second, the lower current Fb intercepts the steam and oil smoke, rising from food during a cooking operation and laden with impurities. The lower current Fb thus prevents the steam and oil smoke from being adhered to the protection filter 46. The steam and oil smoke flows along with the lower current Fb at a position just below the current Fb in the same direction as that of the current Fb.

The lower current Fb is, thereafter, discharged from the cavity 36 into the atmosphere through the air holes (not shown) formed on a sidewall opposite to the sidewall 32. In such a case, the steam and oil smoke is discharged from the cavity 36 into the atmosphere along with the lower current Fb.

As described above, the present invention provides a cooling device for microwave ovens with a halogen lamp. The cooling device is designed to divide the cooling air current, generated from the cooling fan unit 50, into two currents, an upper current Fa and a lower current Fb. The upper and lower currents Fa and Fb are respectively fed to the passages above and below the top wall 30 of a cavity 36.

The cooling device of this invention has the following operational function.

The upper cooling air current flows over the upper surface of the top wall of a cavity while cooling both a halogen lamp and a light reflection plate. Since both the halogen lamp and the reflection plate are cooled by the upper current to an acceptable temperature, the lamp and reflection plate normally and effectively perform their originally designed operational functions for a desired operational time. In a brief description, the halogen lamp is completely cooled by the upper current, thus being normally operated for an expected life span without being undesirably broken. This improves operational reliability and market competitiveness of microwave ovens.

On the other hand, the lower cooling air current flows over the lower surface of the top wall of the cavity while cooling the lamp protection filter. The lower current also protects the lamp protection filter from the steam and oil smoke rising from food during a cooking operation. That is, the lower current intercepts the steam and oil smoke and discharges them from the cavity into the atmosphere. Therefore, it is possible to prevent the steam and oil smoke, laden with impurities, from being adhered to the lamp protection filter. This renders the filter to maintain its desired light transmissivity, thus maximizing the heat efficiency of the microwave oven and reducing the heating time.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

What is claimed is:

1. A microwave oven, comprising:

a light radiating device installed on a top wall of a cavity of the microwave oven and used for radiating heating light into said cavity;

a light transmitting plate provided on said top wall of the cavity and used for admitting the heating light into the cavity and for protecting the light radiating device from airborne contaminants in the cavity; and cooling means for generating a cooling air current and guiding the cooling air current to passages above and below the top wall of the cavity.

2. The microwave oven according to claim 1, wherein said light transmitting plate is made of a light transmitting material.

3. The microwave oven according to claim 1, wherein said cooling means comprises a cooling fan unit placed at a position where the cooling air current is divided by the top wall of the cavity into two currents respectively guided to the passages above and below the top wall of the cavity.

4. The microwave oven according to claim 1, wherein said cooling means comprises:

means for generating the cooling air current; and air current guiding means for dividing said cooling air current from the generating means into two currents and for guiding the two currents to the passages above and below the top wall of the cavity.

5. The microwave oven of claim 1, wherein the cooling means is configured to guide a first portion of the cooling air current to a passage below the top wall of the cavity such that the first portion of the cooling air current helps to prevent airborne contaminants from adhering to the light transmitting plate.

6. The microwave oven of claim 1, wherein the cooling means is configured to guide the cooling air current such that a portion of the cooling air current passing above the top wall of the cavity cools the light radiating device, and such that a portion of the cooling air current passing below the top wall of the cavity cools the light transmitting plate.

7. A microwave oven, comprising:

heat radiating means for generating and emitting heat radiation into a cavity of the microwave oven, wherein the heat radiating means is located on a top wall of the cavity of the microwave oven;

a radiation transmissive plate mounted on the top wall of the cavity and positioned between the heat radiating means and the cavity, wherein the radiation transmissive plate is configured to protect the heat radiating means from contaminants in the cavity; and cooling means for generating a cooling air current, wherein the cooling means is configured such that a first portion of the cooling air current cools the heat radiating means above the top wall of the cavity and such that a second portion of the cooling air current passes over a side of the radiation transmissive plate facing the cavity, and wherein the second portion of the cooling air current also helps to prevent contaminants inside the cavity from adhering to the radiation transmissive plate.

8. The microwave oven of claim 7, further comprising ducting for separating the cooling air current generated by the cooling means into the first and second portions, wherein the ducting is configured to guide the first portion of the cooling air current above the top wall of the cavity, and wherein the ducting is configured to guide the second portion of the cooling air current to the inside of the cavity.

9. The microwave oven of claim 7, wherein a top wall of the cavity separates the cooling air current generated by the cooling means into the first and second portions.

10. A microwave oven, comprising:

a lamp configured to emit heating radiation into a cavity of the microwave oven, wherein the lamp is located on a top wall of the cavity of the microwave oven;

a radiation transmissive plate mounted on the top wall of the cavity and positioned between the lamp and the cavity, wherein the radiation transmissive plate is configured to protect the lamp from contaminants in the cavity; and a cooling fan that generating a cooling air current, wherein the cooling fan is configured such that a first portion of the cooling air current cools the lamp above the top wall of the cavity and such that a second portion of the cooling air current passes over a side of the radiation transmissive plate facing the cavity, and wherein the second portion of the cooling air current also helps to prevent contaminants inside the cavity from adhering to the radiation transmissive plate.

11. The microwave oven of claim 10, further comprising ducting for separating the cooling air current generated by the cooling fan into the first and second portions, wherein the ducting is configured to guide the first portion of the cooling air current above the top wall of the cavity, and wherein the ducting is configured to guide the second portion of the cooling air current to the inside of the cavity.

12. The microwave oven of claim 10, wherein a top wall of the cavity separates the cooling air current generated by the cooling fan into the first and second portions.

* * * * *